US007908957B1

(12) United States Patent
Leung

(10) Patent No.: US 7,908,957 B1
(45) Date of Patent: Mar. 22, 2011

(54) SYNCHRONIZED WEAPON AND AMMUNITION CONTAINER APPARATUS

(75) Inventor: Fee Chan Leung, Hazlet, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 181 days.

(21) Appl. No.: 12/220,394

(22) Filed: Jul. 8, 2008

(51) Int. Cl.
*F41A 9/29* (2006.01)

(52) U.S. Cl. ..... 89/33.14; 89/33.2

(58) Field of Classification Search ..... 89/33.14, 89/33.16, 33.2, 33.25
See application file for complete search history.

(56) References Cited

U.S. PATENT DOCUMENTS 3,602,088 A * 8/1971 Spring ..... 89/36.13
3,670,863 A * 6/1972 Meier et al. ..... 198/803.13
4,469,005 A * 9/1984 Schaulin et al. ..... 89/33.14
4,492,144 A * 1/1985 Dix ..... 89/33.17
4,840,108 A * 6/1989 Hurlemann et al. ..... 89/33.14
4,976,185 A * 12/1990 Wixon et al. ..... 89/35.01
5,076,138 A * 12/1991 Mannhart et al. ..... 89/33.16
5,115,714 A * 5/1992 Muller et al. ..... 89/33.16
5,299,487 A * 4/1994 Bertiller et al. ..... 89/33.14
5,535,661 A * 7/1996 Lescure et al. ..... 89/33.25

* cited by examiner

*Primary Examiner* — Bret Hayes
(74) *Attorney, Agent, or Firm* — Michael Zelenka; Stephen J. Harbulak

(57) ABSTRACT

A synchronized ammunition container apparatus and system is provided with a weapon, rotating automatic arm, ammunition container, and rotatable turret base that allows an anti-aircraft weapon, to traverse, depress and elevate in order to engage a rapid, head-on, fly-over target. The synchronized ammunition container apparatus synchronizes the movement and position of the rotating automatic single arm, ammunition container and rotatable turret base to insure that the ammunition belt will not twist, tangle or break when the weapon follows a rapid, head-on, fly-over target. The synchronized ammunition container system and apparatus gives the user increased flexibility for multiple deployment locations and engaging multiple targets from different directions. Other embodiments include a synchronized anti-aircraft ammunition container and combining the apparatus and anti-aircraft weapon into an integrated anti-aircraft defense system with the synchronized ammunition container.

13 Claims, 3 Drawing Sheets

SYNCHRONIZED WEAPON AND AMMUNITION CONTAINER APPARATUS

GOVERNMENT INTEREST

The invention described herein may be manufactured, used, imported, sold, and licensed by or for the Government of the United States of America without the payment to me of any royalty thereon.

FIELD OF THE INVENTION

The invention generally relates to anti-aircraft weapons. In particular, the invention relates to apparatus and systems providing a synchronized weapon and ammunition container apparatus for rapid-firing anti-aircraft weapons and machine guns.

BACKGROUND OF THE INVENTION

Anti-aircraft warfare began by adapting machine guns and artillery pieces to engage military aircraft from the ground. Adaptations of ground weapons used before and during World War I and the increased use of tactical aircraft led to more specialized anti-aircraft guns being developed during the World War II era. Since then guided missiles have replaced many traditional anti-aircraft weapons. However, anti-aircraft weapons are still used throughout the world in smaller countries that are unable to deploy sophisticated guided missile systems.

Even though anti-aircraft weapons are still used extensively throughout the world, they still suffer from a number of disadvantages, shortcomings and limitations, particularly the belt fed anti-aircraft machine guns (0.30-0.50 cal). These types of anti-aircraft weapons engage targets while mounted mainly on ground vehicles. In such cases when the user engages oncoming targets from the air, the anti-aircraft weapon usually elevates the barrel as the target gets closer, but current anti-aircraft guns cannot readily follow an oncoming, rapid, head-on target flying directly over the anti-aircraft site. FIGS. 1A and 1B illustrate the head-on, overhead target problem with prior art anti-aircraft weapons.

FIG. 1A shows a prior art anti-aircraft weapon aimed at the quickly-moving target with the barrel at an almost horizontal angle. At a certain point, the anti-aircraft weapon can no longer be easily elevated due to the configuration of the mount. The anti-aircraft weapon must traverse the barrel to the rear before it can engage the target flying directly over and behind the gun site. These types of mount limitations prevent the user from continuously engaging any on-coming, rapid, head-on, fly-over target. FIG. 1B shows the rapid, head-on, fly-over target that has flown past the prior art anti-aircraft weapon. FIG. 1B illustrates this problem by showing that the anti-aircraft weapon is no longer in a position to fire at the rapid, head-on, fly-over target until the anti-aircraft weapon, and possibly its platform, have been re-positioned to follow and engage the target.

Movement of the anti-aircraft weapon after fly-over causes an additional prior art problem, which is clearly illustrated in FIG. 2. Referring now to FIG. 2, the anti-aircraft weapon is shown after weapon rotation in pursuit of the rapid, head-on, fly-over overhead target with a twisted and tangled ammunition belt. Even if the mount for the prior art anti-aircraft weapon was designed to allow the weapon to elevate to the rear, the ammunition belt would still twist, tangle, and jam because the location of the ammunition box relative to the weapon feed is not mechanically compatible. The twisted and tangled ammunition belt causes the anti-aircraft weapon to jam and misfire, which exposes the anti-aircraft crew and the entire defensive position to the life-threatening hazards and dangers of hostile enemy action. Thus, there has been a long-felt need for an anti-aircraft weapon that can be rapidly re-positioned in such a way as to follow the target directly over the weapon after fly-over with an ammunition box mechanism that will not twist, tangle and jam after following the fly-over target.

None of the currently available anti-aircraft weapons allow the user to engage the rapid, head-on, fly-over target in a way that does not impede the operation of the ammunition belt and also avoids the other disadvantages, shortcomings and limitations of prior art devices.

SUMMARY OF THE INVENTION

In order to answer the long-felt need for an anti-aircraft weapon that can follow and engage a rapid, head-on, fly-over target without twisting or tangling the ammunition belt mechanism, the present invention provides a synchronized ammunition container apparatus and system. The synchronized ammunition container comprises a rotating automatic single arm, ammunition container, and a rotatable turret base that allows the belt-fed anti-aircraft weapon to traverse, depress and elevate in a way that insures that the ammunition belt will not twist, tangle or break. This invention's synchronized ammunition container apparatus and system answers the long-felt need for an anti-aircraft weapon that overcomes the disadvantages, shortcomings, and limitations of prior art anti-aircraft weapons. In accordance with the present invention, the military or law enforcement user can now safely and efficiently defend against a rapid, head-on, fly-over air assault with a new anti-aircraft weapon system that allows the user to fire after the target has already passed over the anti-aircraft position without twisting and tangling ammunition belts like prior art weapon systems.

Accordingly, it is an object of this invention to provide a weapon and ammunition container mounted on a rotating automatic arm connected to the base of the rotatable turret to follow and engage a rapid, head-on, fly-over target.

It is another object of this invention to provide a synchronized ammunition container mounted on a rotating automatic arm connected to the base of the rotatable turret to follow and engage the rapid, head-on, fly-over target without having the ammunition belt mechanism become twisted and tangled.

It is a further object of this invention to provide a synchronized ammunition container system to rapidly supply ammunition to a belt-fed anti-aircraft weapon so that the weapon can follow and engage the rapid, head-on, fly-over target without having the ammunition belt mechanism become twisted and tangled.

These and other objects are advantageously accomplished with the present invention providing a synchronized ammunition container apparatus and system comprising an ammunition container, rotating automatic arm, and rotatable turret base that allows a belt-fed weapon, such as an anti-aircraft weapon, to traverse, depress and elevate in order to engage the rapid, head-on, fly-over target. In accordance with the present invention, the synchronized ammunition container apparatus and system synchronizes the movement and position of the ammunition container to insure that the ammunition belt will not twist, tangle or break when the weapon follows the rapid, head-on, fly-over target. In accordance with the present invention, the synchronized ammunition container apparatus and system gives the user increased flexibility for multiple deployment locations and engaging multiple targets from different directions.

Other embodiments of the synchronized ammunition container apparatus and system beside anti-aircraft weapons are also considered to be within the contemplation of the present invention. These other advantageous implementations include any other belt-fed or machine-gun type weapon, and mounting the weapon on numerous other platforms such as ships, vehicles and stationary locations to engage moving air and ground targets. Other embodiments of the present invention include a synchronized anti-aircraft ammunition container and an integrated anti-aircraft defense system that includes the synchronized ammunition container.

DETAILED DESCRIPTION OF THE DRAWINGS

Figure 1A:
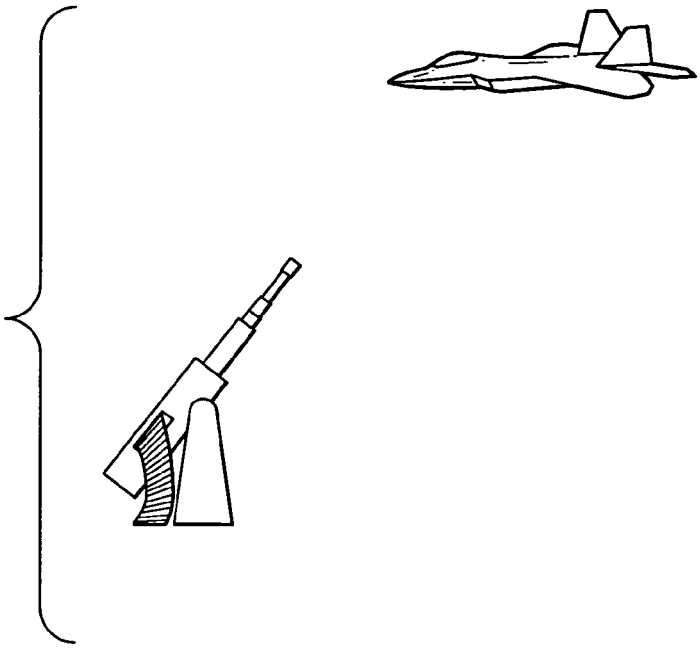
FIG. 1A (PRIOR ART)
FIG. 1A depicts a prior art anti-aircraft weapon aimed at a flying target.
Figure 1B:
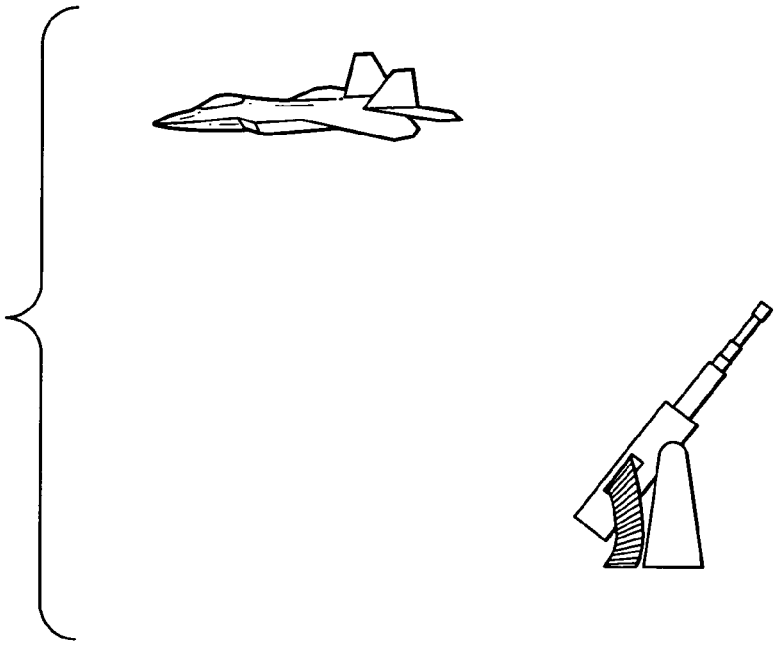
FIG. 1B (PRIOR ART)
FIG. 1B depicts the flying target passing the prior art anti-aircraft weapon.
Figure 2:
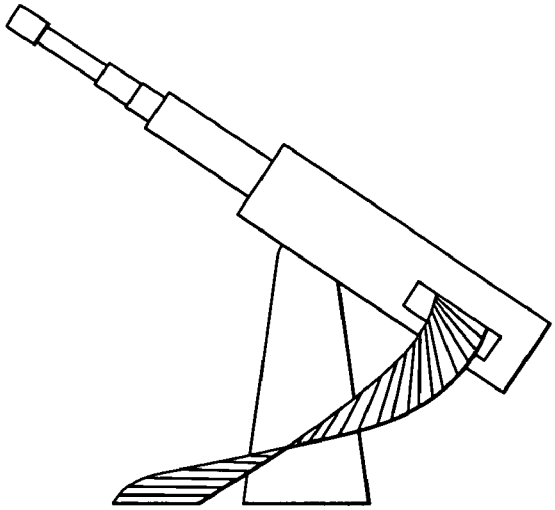
FIG.2 (PRIOR ART)
FIG. 2 depicts the prior art anti-aircraft weapon after weapon rotation with a twisted and tangled ammunition belt.

FIGS. 1A, 1B, and 2 illustrated the problems, shortcomings and deficiencies of a prior art anti-aircraft weapon mounted on a conventional platform. Currently, whenever a user is required to defend against a rapid, head-on, fly-over air assault, the prior art anti-aircraft weapon would be out of position to fire at such a target until the anti-aircraft weapon and platform are re-positioned to follow and engage the target. Movement of the anti-aircraft weapon after fly-over causes the additional prior art problem of twisting and tangling the ammunition belt which causes the anti-aircraft weapon to jam and misfire, exposing the anti-aircraft crew and the defensive position to the life-threatening dangers of hostile enemy action. In accordance with the synchronized anti-aircraft ammunition container and systems of the present invention, the user can now follow the rapid, head-on, fly-over target to the rear of the gun position without tangling and twisting the ammunition belt.

Figure 3:
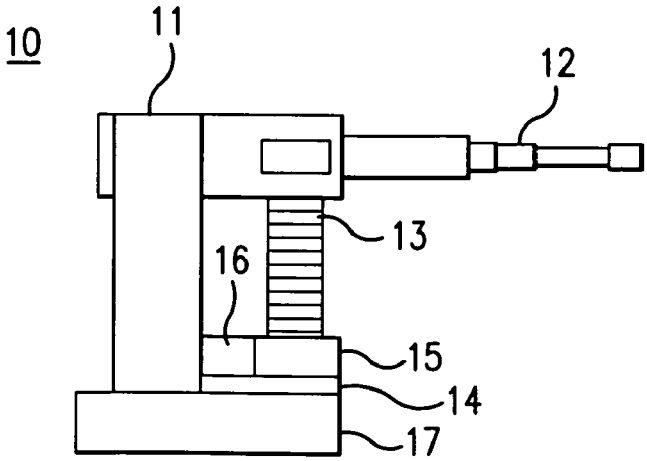
FIG. 3 is a simplified conceptual side view of the synchronized ammunition container system of the present invention.

Referring now to the drawings, FIG. 3 is a simplified conceptual side view of the synchronized ammunition container system 10 of the present invention, comprising a weapon 11, muzzle 12, ammunition belt 13, automatic arm 14, ammunition container 15, means for rotation control 16, and rotatable turret base 17. In accordance with this invention, the weapon 11 is fed the ammunition belt 13 from a large, high capacity ammunition container 15 that is mounted on an automatic arm 14 that is positioned separately from the weapon 11. The ammunition container 15, which is mounted on the rotating automatic arm 14, allows the ammunition container 15 to be moved around the rotatable turret base 17. The automatic arm 14 is connected to the rotatable turret base and is responsive to commands from a means for rotation control 16 causing the rotating automatic arm 14 and consequently, the ammunition container 15, to be repositioned whenever the muzzle 12 of the weapon 11 is elevated or moved. The weapon 11 is preferably an anti-aircraft weapon, but any belt-fed machine gun or similar weapon could also be used.

The cooperation of the weapon 11, muzzle 12, ammunition belt 13, automatic arm 14, ammunition container 15, and rotatable turret base 17 allows these structures to move in a way that the ammunition belt 13 will not twist or tangle with the weapon 11 or muzzle 12. Locating the ammunition container 15 on the rotating automatic single arm 14 in this way synchronizes the movements of those components and allows the user to engage a rapid, head-on, fly-over target and continuously follow the target after fly-over without the ammunition belt 13 twisting, tangling or breaking when following the target. In accordance with the present invention, the synchronized ammunition container system 10 gives the user increased flexibility for multiple deployment locations, multiple platforms, and engaging multiple targets from different directions.

In operation, the rotation control means 16 can be a computer that responds to weapon movements by the user so that when the user elevates the weapon 11 or muzzle 12, the computer will rapidly collect and analyze weapon elevation data and then direct the movement of the rotating automatic arm 14, and consequently ammunition container 15, to minimize the stress on the ammunition belt 13 feeding into the weapon 11. For example, when the weapon 11 is elevated so that the muzzle 12 begins pointing rearward, the computer will move the rotating automatic arm 14 and ammunition container 15 in a complementary manner so that the ammunition belt 13 will flip and avoid tangling and kinking. In accordance with the present invention, the computer of the rotation control means 16 coordinates the movement of the ammunition container 15 when the user elevates the muzzle 12 of the weapon 11 from zero degrees (pointing forward) to 180 degrees (pointing rearward). In a confined space, a vehicle equipped with this invention's synchronized ammunition container system 10 can aim the weapon 11 to the rear without traversing the rotatable turret base 17 to the rear, which would otherwise be impossible or extremely difficult in a narrow street or alleyway. FIG. 3 depicts the rotation control means 16 located on the automatic arm 14, but it can be located elsewhere in, or near, the system 10.

Figure 4A:
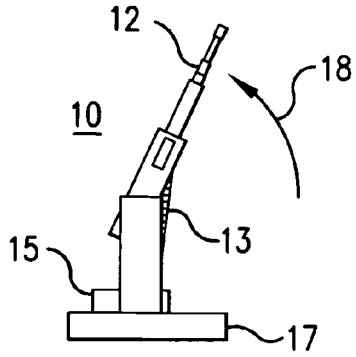
FIGS. 4A-4B are side and top conceptual views of the synchronized ammunition container system of the present invention facing frontwards.

FIGS. 4A-6B are time-sequence conceptual views that illustrate the operation of this invention's synchronized ammunition container system 10, using the same numerals for like structures. FIG. 4A is a side view that depicts the muzzle 12 elevated, as indicated by arrow 18, in an effort to engage the rapid, head-on, fly-over target in front of the gun position. FIG. 4B is a top view that more clearly shows the position of ammunition container 15 in relation to muzzle 12. As the FIG. 4A muzzle 12 elevates, FIG. 4B shows the ammunition container 15 mounted on the automatic arm 14, rotating in a counter-clockwise direction, indicated by arrow 19, without impeding the feeding of ammunition belt 13 into the weapon 11. In FIG. 4B, the rotating automatic arm 14 is depicted by broken lines underneath the ammunition container 15 and solid lines that extend under the weapon 11.

Figure 5A:
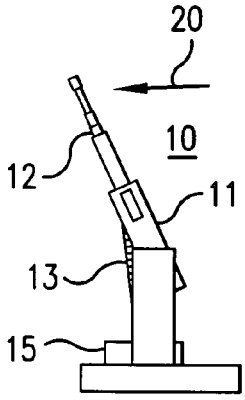
FIGS. 5A-5B are side and top conceptual views of the synchronized ammunition container system of the present invention pointing overhead.
Figure 4B:
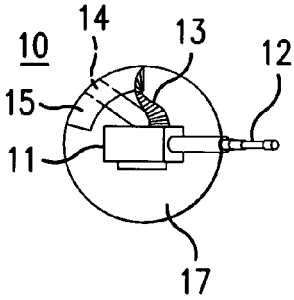
Figure 5B:
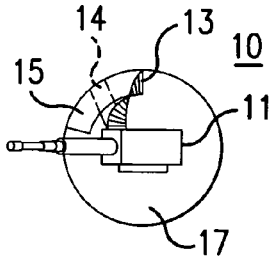

Similarly, FIG. 5A is a side view of the synchronized ammunition container system 10 showing the muzzle 12 pointing rearwards, as indicated by arrow 20, in a continuing effort to follow the fly-over target that is flying behind the gun position. Top view FIG. 5B shows the rotating automatic arm 14 and the ammunition container 15 continuing to feed the ammunition belt 13 to the weapon 11 without the ammunition belt 13 tangling. FIG. 5B also depicts the automatic arm 14 with broken lines underneath the ammunition container 15 and solid lines extending under weapon 11.

Figure 6A:
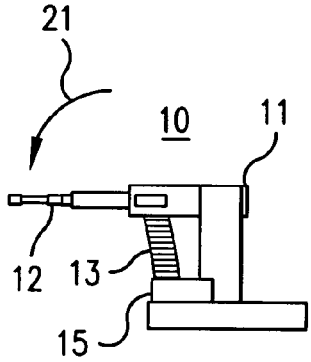
FIGS. 6A-6B are side and top conceptual views of the synchronized ammunition container system of the present invention facing rearwards.
Figure 6B:
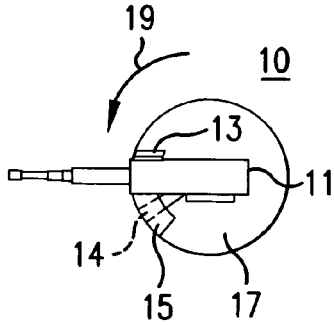

Side view FIG. 6A illustrates the muzzle 12 of weapon 11 facing rearwards, as indicated by arrow 21, to continuously follow the fly-over target, while top view FIG. 6B shows the rotating automatic arm 14 and ammunition container 15 moving in a counter clockwise direction, as indicated by arrow 19, without the ammunition belt 13 becoming entangled with the weapon 11. FIG. 6B also illustrates the automatic arm 14 by broken lines underneath ammunition container 15 and solid lines that extend under the weapon 11.

In accordance with the present invention, the rotation control means 16 of the system 10 innovatively provides a corresponding position for the rotating automatic arm 14, ammunition container 15, and rotatable turret 17 for each elevation position of the weapon 11 to insure that there is no mechanical impediment and undue stress on the ammunition belt 13 that can impact the rate that the ammunition belt 13 feeds the weapon 11. The thrust can traverse while the weapon 11 elevates and the ammunition container 15 rotates in concert.

This invention's synchronized ammunition container system 10 answers the long-felt need for a weapon system that overcomes the prior art difficulties of the rapid, head-on, fly-over air assault without entangling the ammunition belt 13. This invention provides the user with increased flexibility of movement and a full range of motion to effectively and continuously engage multiple targets coming from opposite directions more rapidly than conventional anti-aircraft weapon systems. In comparison with prior art anti-aircraft weapons systems, this invention's synchronized ammunition container system 10 also provides additional flexibility of movement when deployed in congested urban areas.

A number of variations to the synchronized ammunition container system 10 are considered to be within the contemplation of this invention, including the use of other belt-fed weapon systems such as a machine gun, deploying the system on different types of platforms such as ships, vehicles and stationary locations, and engaging moving air, naval and ground targets. Other embodiments of the present invention include a synchronized anti-aircraft ammunition container and an integrated anti-aircraft defense system that includes the synchronized ammunition container.

It is to be further understood that other features and modifications to the foregoing detailed description are within the contemplation of the present invention, which is not limited by this detailed description. Those skilled in the art will readily appreciate that any number of configurations of the present invention and numerous modifications and combinations of materials, components, geometrical arrangements and dimensions can achieve the results described herein, without departing from the spirit and scope of this invention. Accordingly, the present invention should not be limited by the foregoing description, but only by the appended claims.

What is claimed is:

1. A synchronized ammunition container system, comprising:

a weapon, including and fed by an ammunition belt, and having a muzzle;

a rotatable turret base;

an ammunition container;

said weapon being rotatably mounted on said rotatable turret base;

an automatic arm mounted on said base of said turret supports said ammunition container;

said ammunition belt being stored in said ammunition container;

said automatic arm, including and being responsive to a means for rotation control, rotates around said base when a user elevates said muzzle;

said automatic arm, said muzzle and said rotatable turret base configured and dimensioned to cooperate to move in a synchronized manner, said automatic arm being movable separately and apart from each of said muzzle and said rotatable turret base; and said ammunition belt being fed from said ammunition container to said weapon without said ammunition belt being tangled with said muzzle so as to allow said user to continuously follow a target at a full rate of firepower in a full range of elevated motion in which said muzzle moves through an angle of at least over 90 degrees from the horizontal and wherein said full range of elevated motion of said muzzle extends from about 0 degrees pointing forward to about 180 degrees pointing rearward.

2. The synchronized ammunition container system, as recited in claim 1, wherein the target is a head-on, fly-over target.

3. The synchronized ammunition container system, as recited in claim 2, wherein said weapon being a machine gun.

4. The synchronized ammunition container system, as recited in claim 3, wherein said weapon being an anti-aircraft gun.

5. The synchronized ammunition container system, as recited in claim 4, wherein said rotation control means being operated by a computer.

6. The synchronized ammunition container system, as recited in claim 5, wherein said system being included in an integrated anti-aircraft defense system.

7. A synchronized anti-aircraft ammunition container system, comprising:

an anti-aircraft weapon, including and fed by an ammunition belt, and having a muzzle;

a rotatable turret base;

an ammunition container;

said anti-aircraft weapon being rotatably mounted on said rotatable turret base;

an automatic arm mounted on said base of said turret supports said ammunition container;

said ammunition belt being stored in said ammunition container;

said automatic arm, including and being responsive to a means for rotation control, rotates around said base when a user elevates said muzzle;

said automatic arm, said muzzle and said rotatable turret base configured and dimensioned to cooperate to move in a synchronized manner, said automatic arm being movable separately and apart from each of said muzzle and said rotatable turret base; and said ammunition belt being fed from said ammunition container to said weapon without said ammunition belt being tangled with said muzzle so as to allow said user to continuously follow a target at a full rate of firepower in a full range of elevated motion in which said muzzle moves through an angle of at least over 90 degrees from the horizontal and wherein said full range of elevated motion of said muzzle extends from about 0 degrees pointing forward to about 180 degrees pointing rearward.

8. The synchronized anti-aircraft ammunition container system, as recited in claim 7, wherein the target is a head-on, fly-over target.

9. The synchronized anti-aircraft ammunition container system, as recited in claim 8, further comprising a computer and wherein said rotation control means is operated by said computer.

10. The synchronized anti-aircraft ammunition container system, as recited in claim 9, further comprising an integrated anti-aircraft system and wherein said container system is included in said integrated anti-aircraft system.

11. An integrated anti-aircraft defense system with a synchronized ammunition container, comprising:

an anti-aircraft weapon, including and fed by an ammunition belt, and having a muzzle;

a rotatable turret base;

said anti-aircraft weapon being rotatably mounted on said rotatable turret base;

an automatic arm mounted on said base of said turret supports said ammunition container;

said ammunition belt being stored in said ammunition container;

said automatic arm, including and being responsive to a means for rotation control, rotates around said base when a user elevates said muzzle;

said automatic arm, said muzzle and said rotatable turret base configured and dimensioned to cooperate to move in a synchronized manner, said automatic arm being movable separately and apart from each of said muzzle and said rotatable turret base; and said ammunition belt being fed from said ammunition container to said weapon without said ammunition belt being tangled with said muzzle so as to allow said user to continuously follow a target at a full rate of firepower in a full range of elevated motion in which said muzzle moves through an angle of at least over 90 degrees from the horizontal and wherein said full range of elevated motion of said muzzle extends from about 0 degrees pointing forward to about 180 degrees pointing rearward.

12. The integrated anti-aircraft defense system with the synchronized ammunition container, as recited in claim 11, wherein the target is a head-on, fly-over target.

13. The integrated anti-aircraft defense system with the synchronized ammunition container, as recited in claim 12, further comprising a computer and wherein said rotation control means is operated by said computer.

* * * * *